US009290715B2

(12) United States Patent
Watanabe et al.

(10) Patent No.: US 9,290,715 B2
(45) Date of Patent: Mar. 22, 2016

(54) GREASE COMPOSITION

(71) Applicant: SHELL OIL COMPANY, Houston, TX (US)

(72) Inventors: Kazuya Watanabe, Tokyo (JP); Keiji Tanaka, Tokyo (JP)

(73) Assignee: Shell Oil Company, Houston, TX (US)

( * ) Notice: Subject to any disclaimer, the term of this patent is extended or adjusted under 35 U.S.C. 154(b) by 0 days.

(21) Appl. No.: 14/360,677

(22) PCT Filed: Nov. 28, 2012

(86) PCT No.: PCT/EP2012/073879
§ 371 (c)(1),
(2) Date: May 27, 2014

(87) PCT Pub. No.: WO2013/079559
PCT Pub. Date: Jun. 6, 2013

(65) Prior Publication Data

US 2014/0329730 A1 Nov. 6, 2014

(30) Foreign Application Priority Data

Nov. 28, 2011 (JP) ..... 2011-259528

(51) Int. Cl.

| | |
|---|---|
| ***C10M 173/00*** | (2006.01) |
| ***C10M 123/02*** | (2006.01) |
| ***C10M 169/02*** | (2006.01) |
| ***C10M 117/08*** | (2006.01) |
| *C10M 113/08* | (2006.01) |
| *C10M 117/02* | (2006.01) |

(52) U.S. Cl.
CPC ..... *C10M 123/02* (2013.01); *C10M 117/08* (2013.01); *C10M 169/02* (2013.01); *C10M 113/08* (2013.01); *C10M 117/02* (2013.01); *C10M 2201/0626* (2013.01); *C10M 2203/1025* (2013.01); *C10M 2205/0285* (2013.01); *C10M 2207/1225* (2013.01); *C10M 2207/1245* (2013.01); *C10M 2207/1256* (2013.01); *C10M 2207/1415* (2013.01); *C10N 2220/02* (2013.01); *C10N 2230/08* (2013.01); *C10N 2240/02* (2013.01); *C10N 2240/046* (2013.01); *C10N 2250/10* (2013.01)

(58) Field of Classification Search
CPC ..... C10M 2207/125; C10N 2210/01
USPC ..... 508/178
See application file for complete search history.

(56) References Cited

U.S. PATENT DOCUMENTS

| | | | |
|---|---|---|---|
| 2,846,392 | A | 8/1958 | Morway et al. |
| 2,976,242 | A | 3/1961 | Morway |

FOREIGN PATENT DOCUMENTS

| | | |
|---|---|---|
| CN | 101935573 | 1/2011 |
| CN | 101935578 | 1/2011 |
| JP | 2006131721 | 5/2006 |
| JP | 2008231310 | 10/2008 |
| JP | 2009249419 | 10/2009 |

OTHER PUBLICATIONS

State Intellectual Property Office of the Peoples's Republic of China, CCPIT, Ref. No. TS8220-CN-PCT, 1st Office Action dated Jan. 22, 2015 for Application No. 201280058328.8.

*Primary Examiner* — Vishal Vasisth

(57) ABSTRACT

A calcium complex grease composition is disclosed. The grease composition has a high dropping point and a suitable thickness and is stable to heat.

21 Claims, No Drawings

GREASE COMPOSITION

PRIORITY CLAIM

The present application is the National Stage (§371) of International Application No. PCT/EP2012/073879, filed 28 Nov. 2012, which claims priority from Japanese application no. 2011-259528, filed Nov. 28, 2011, the disclosures of which are incorporated herein by reference.

TECHNICAL FIELD OF THE INVENTION

The present invention relates to a grease composition. More specifically, the present invention relates to a calcium complex grease composition containing a calcium complex soap having a high dropping point.

BACKGROUND OF THE INVENTION

As progress has been made in engineering technologies such as vehicles and electrical equipment over the years, many types of equipment have become smaller, lighter and higher in output, and operating conditions have increased in temperature and become harsher. As a result, greases used in a variety of equipment have needed to exhibit improved performance at higher temperatures, and grease compositions having high dropping points and excellent thermal stability have been proposed.

Meanwhile, recent years have seen an increase in demand not only for improved performance of greases at high temperatures, but also for human safety during use and the use of materials having little environmental impact during production, and a grease that fulfils these requirements is needed. Of these requirements, grease compositions that contain lithium complex soaps, which are obtained by improving lithium soaps, or urea as thickening agents have high dropping points and exhibit excellent heat resistance. Therefore, various proposals have been made for these types of grease composition in order to further improve these properties.

As a grease composition that contains a lithium soap as a thickening agent, JP 2006-131721 proposes a lithium complex grease which comprises a lithium salt of an aliphatic monocarboxylic acid, a lithium salt of an aromatic dibasic acid and a lithium salt of an aliphatic dibasic acid, which has a higher dropping point than a lithium grease and which has a wide range of usage temperatures. However, lithium, which is a raw material of the lithium grease, is used in a wide variety of applications in addition to greases, and because there has been a high demand for lithium recently, there are concerns that lithium resources will become depleted and the price of lithium will increase in the future. In addition, because the lithium complex grease involves reacting two types of fatty acid in two stages, the production process of the lithium complex grease is complicated and requires a long period of time.

In addition, as a grease composition that uses urea as a thickening agent, JP 2008-231310 proposes a diurea grease able to be used at high temperatures for a long period of time. However, amine compounds such as aniline, which are used as raw materials, are extremely toxic and must be handled with sufficient care during production, meaning that safety is an issue.

As a result, grease compositions that use calcium as a thickening agent, which are superior in terms of safety, environmental burden and production costs, have been investigated as replacements for grease compositions that use lithium soaps or urea as thickening agents, and cannot therefore be said to be satisfactory in terms of safety and environmental burden.

However, greases that use calcium soaps as thickening agents are generally inferior to lithium greases, lithium complex greases and urea greases in terms of dropping point and heat resistance, and do not therefore fulfil the recent requirements of greases.

Proposals have been made for greases known as calcium complex greases, which generally use a calcium complex soap of a higher fatty acid and a lower fatty acid as a thickening agent, as greases that fulfil such requirements.

In particular, JP 2009-249419 proposes a calcium complex grease, which uses calcium salts of a dibasic acid and a fatty acid as a thickening agent, as a calcium complex grease having a high dropping point. However, in addition to the problem of being unable to maintain a suitable thickness if the added quantity of the thickening agent is low, this calcium complex grease is limited in terms of the form of the dibasic acid, and especially terephthalic acid, used as a raw material, and involves production problems such as requiring terephthalic acid to be introduced at the high temperature of 120° C.

The problem to be addressed by the present invention is to provide a calcium complex grease which exhibits equivalent or superior heat resistance to a grease that uses a lithium soap or urea as a thickening agent by maintaining (having or ensuring) a high dropping point and which can maintain a suitable thickness even if the quantity of thickening agent is low.

SUMMARY OF THE INVENTION

The inventors found that it was possible to solve this problem by using a calcium soap containing a specific higher fatty acid, a specific lower fatty acid and a specific aromatic fatty acid. Accordingly, the present invention provides a grease composition containing a base oil and, as a thickening agent, a calcium complex soap, wherein a substituted or unsubstituted straight chain higher mono-fatty acid having 18 to 22 carbon atoms, an aromatic mono-fatty acid having a substituted or unsubstituted benzene ring and a straight chain saturated lower mono-fatty acid having 2 to 4 carbon atoms are used as fatty acids in the calcium complex soap.

The grease composition may have a dropping point of at least 180° C. or higher than this.

In addition, the grease composition may contain 2 to 15 parts by mass of the straight chain higher mono-fatty acid, 0.5 to 2 parts by mass of the aromatic mono-fatty acid and 1 to 5 parts by mass of the straight chain saturated lower mono-fatty acid in terms of raw materials relative to 100 parts by mass of the total blending quantity of the grease composition.

Moreover, said grease composition may be one in which the straight chain higher mono-fatty acid is one or more fatty acids selected from among stearic acid, oleic acid, 12-hydroxystearic acid and behenic acid, the aromatic mono-fatty acid is one or more fatty acids selected from among benzoic acid and para-toluic acid, and the straight chain saturated lower mono-fatty acid is acetic acid.

Furthermore, a method for producing said grease composition may be one which includes a step of generating a calcium complex soap by adding the straight chain higher mono-fatty acid, the aromatic mono-fatty acid, the straight chain saturated lower mono-fatty acid and calcium hydroxide to the base oil.

The calcium complex grease composition according to the present invention has a high dropping point and can maintain a suitable thickness even if the quantity of thickening agent is low, and can therefore be used in high-temperature environments in which conventional lithium-based greases and urea greases cannot be used, and also achieves the effect of being able to achieve safety, environmental properties and low cost.

DETAILED DESCRIPTION OF THE INVENTION

The grease composition of the present aspect contains a "base oil" and a "thickening agent" as essential constituent components.

The base oil used in the grease composition of the present aspect is not particularly limited. For example, mineral oils, synthetic oils and vegetable oils used in ordinary grease compositions, and mixtures thereof, can be used as appropriate. Specific examples thereof include individual or mixed base oils belonging to group 1, group 2, group 3, group 4 and so on in the base oil categories of the API (American Petroleum Institute).

Group 1 base oils include paraffin-based mineral oils obtained by subjecting a lubricating oil distillate, which is obtained by atmospheric distillation of crude oil, to an appropriate combination of refining means, such as solvent refining, hydrogenation refining or dewaxing. Group 2 base oils include paraffin-based mineral oils obtained by subjecting a lubricating oil distillate, which is obtained by atmospheric distillation of crude oil, to an appropriate combination of refining means, such as hydrogenation refining or dewaxing. A group 2 base oil, which is refined using a hydrogenation refining method such as a method used by Gulf and in which the total sulphur content is less than 10 ppm and the aromatic content is 5% or lower, can be preferably used in the present invention. Group 3 base oils and group 2+ base oils include paraffin-based mineral oils produced by subjecting a lubricating oil distillate, which is obtained by atmospheric distillation of crude oil, to a high degree of hydrogenation refining, base oils refined by an Isodewax process, in which waxes generated in a dewaxing process are converted/dewaxed into iso-paraffins, and base oils refined by Mobil's Wax isomerisation process, and these can be preferably used in the present aspect.

Examples of synthetic oils include polyolefins, diesters of dibasic acids, such as dioctyl sebacate, polyol esters, alkylbenzenes, alkylnaphthalenes, esters, polyoxyalkylene glycols, polyoxyalkylene glycol esters, polyoxyalkylene glycol ethers, polyphenyl ethers, dialkyldiphenyl ethers, fluorine-containing compounds (perfluoropolyethers, fluorinated polyolefins and the like) and silicones. The abovementioned polyolefins include a variety of olefin polymers and hydrogenated products thereof. It is possible to use an arbitrary olefin, and ethylene, propylene, butene, and α-olefins having 5 or more carbon atoms and the like can be used. When producing a polyolefin, it is possible to use one of the abovementioned olefins or a combination of two or more types thereof. Polyolefins known as poly-α-olefins (PAO) are particularly preferred, and these are group 4 base oils.

Oils obtained from GTL (gas-to-liquid) processes, which are synthesised by the Fischer Tropsch method of converting natural gas into liquid fuel, have a much lower sulphur content and aromatic content and a much higher paraffin component ratio than mineral oil base oils refined from crude oil, and therefore have excellent stability to oxidation and extremely low evaporative losses, and can therefore be preferably used as the base oil in the present aspect.

The thickening agent used in the present aspect is a calcium complex soap obtained by reacting a plurality of fatty acids with a specific base (typically calcium hydroxide). The fatty acid sources for the calcium complex soap according to the present aspect are (1) a higher fatty acid, (2) an aromatic fatty acid and (3) a lower fatty acid. The fatty acid components (anionic components) of said calcium complex soap will now be explained in detail.

(1) The higher fatty acid used in the present aspect is a straight chain higher monocarboxylic acid having 18 to 22 carbon atoms. Here, said straight chain higher monocarboxylic acid may be unsubstituted or have one or more substituent groups (for example hydroxyl groups and the like). In addition, said straight chain higher monocarboxylic acid may be a saturated fatty acid or an unsaturated fatty acid, but a saturated fatty acid is preferred. Specific examples of saturated fatty acids include stearic acid (octadecanoic acid, 18 carbon atoms), tuberculostearic acid (nonadecanoic acid, 19 carbon atoms), arachidic acid (eicosanoic acid, 20 carbon atoms), heneicosanoic acid (21 carbon atoms), behenic acid (docosanoic acid, 22 carbon atoms) and hydroxystearic acid (18 carbon atoms, oil of hydrogenated castor oil fatty acid), and specific examples of unsaturated fatty acids include oleic acid, linolic acid and linolenic acid (18 carbon atoms), gadoleic acid, eicosadienoic acid and mead acid (20 carbon atoms), and erucic acid and docosadienoic acid (22 carbon atoms). Moreover, it is possible to use one of these fatty acids or a combination thereof. For example, when an unsaturated fatty acid is used, it is preferable to use the unsaturated fatty acid in combination with a saturated fatty acid.

(2) The aromatic fatty acid used in the present aspect is an aromatic mono-fatty acid having a substituted or unsubstituted benzene ring. Here, said aromatic mono-fatty acid may be unsubstituted or have one or more substituent groups (for example, an o-, m- or p-alkyl group, a hydroxy group, an alkoxy group and the like). Specific examples thereof include benzoic acid, methylbenzoic acid (p-, m- or o-toluic acid), dimethylbenzoic acid (xylylic acid, hemellitic acid or mesitylenic acid), trimethylbenzoic acid (prehnitylic acid, durylic acid, or α, β- or γ-isodurylic acid), 4-isopropylbenzoic acid (cuminic acid), hydroxybenzoic acid (salicylic acid and the like), dihydroxybenzoic acid (pyrocatechuic acid, α-, β- or γ-resorcylic acid, gentisic acid or protocatechuic acid), trihydroxybenzoic acid (gallic acid), hydroxy-methylbenzoic acid (p-, m- or o-cresotinic acid), dihydroxy-methylbenzoic acid (orsellinic acid), methoxybenzoic acid (p-, m- or o-anisic acid), dimethoxybenzoic acid (veratric acid), trimethoxybenzoic acid (asaronic acid), hydroxy-methoxybenzoic acid (vanillic acid or isovanillic acid) and hydroxy-dimethoxybenzoic acid (syringic acid). Moreover, it is possible to use one of these fatty acids or a combination thereof. Moreover, the alkyl groups and the alkyl moieties in the alkoxy groups in the "substituent groups" in the present specification are straight chain or branched chain alkyl groups having 1 to 4 carbon atoms.

(3) The lower fatty acid used in the present aspect is a straight chain saturated lower mono-fatty acid having 2 to 4 carbon atoms. Specific examples thereof include acetic acid (2 carbon atoms), propionic acid (3 carbon atoms) and butyric acid (4 carbon atoms). Of these, acetic acid (2 carbon atoms) is particularly preferred. Moreover, it is possible to use one of these fatty acids or a combination thereof.

Of these, from the perspectives of quality of texture, viscoelasticity (body), ease of production and so on, a combination of stearic acid as the straight chain higher monocarboxylic acid, benzoic acid as the aromatic fatty acid and acetic acid as the lower fatty acid is most preferred.

In addition to the abovementioned calcium complex soap, it is possible to additionally use another thickening agent in the grease composition of the present aspect. Such other thickening agents include calcium triphosphate, alkali metal soaps, alkali metal complex soaps, alkaline earth metal soaps, alkaline earth metals complex soaps (other than the calcium complex soap), alkali metal sulfonates, alkaline earth metals sulfonates, other metal soaps, terephthalamate metal salts, clays, silica (silicon oxide) such as silica aerogels, and fluororesins such as polytetrafluoroethylene, and it is possible to use one of these other thickening agents or a combination of two or more types thereof. In addition, it is possible to use any other material able to impart a thickening effect to a liquid substance.

Additives such as antioxidants, corrosion inhibitors, oil agents, extreme pressure additives, anti-wear additives, solid lubricants, metal deactivators, polymers, metal-based detergents, non-metal-based detergents, anti-foaming agents, colourants and water repellency agents can be added to the grease composition of the present aspect at a total optional component content of approximately 0.1 to 20 parts by mass relative to 100 parts by mass of the overall grease composition. Antioxidants include, for example, 2,6-di-t-butyl-4-methylphenol, 2,6-di-t-butyl-paracresol, p,p'-dioctyldiphenylamine, N-phenyl-α-naphthylamine and phenothiazine. Corrosion inhibitors include for example, paraffin oxides, metal salts of carboxylic acids, metal salts of sulphonic acids, carboxylic acid esters, sulphonic acid esters, salicylic acid esters, succinic acid esters, sorbitan esters and a variety of amine salts. Oil agents, extreme pressure additives and anti-wear additives include, for example, zinc dialkyldithiophosphate sulphides, zinc diallyldithiophosphate sulphide, zinc dialkyldithiocarbamate sulphides, zinc diallyldithiocarbamate sulphide, molybdenum dialkyldithiophosphate sulphides, molybdenum diallyldithiophosphate sulphide, molybdenum dialkyldithiocarbamate sulphides, molybdenum diallyldithiocarbamate sulphide, organic molybdenum complexes, olefin sulphides, triphenyl phosphate, triphenyl phosphothionate, tricresyl phosphate, other phosphoric acid esters, and sulphurised oils and fats. Solid lubricants include, for example, molybdenum disulphide, graphite, boron nitride, melamine cyanurate, PTFE (polytetrafluoroethylene), tungsten disulphide, and graphite fluoride. Metal deactivators include, for example, N,N'-disalicylidene-1,2-diaminopropane, benzotriazole, benzimidazole, benzothiazole and thiadiazole. Polymers include, for example, polybutene, polyisobutene, polyisobutylene, polyisoprene and polymethacrylates. Metal-based detergents include, for example, metal sulphonates, metal salicylates and metal phenates. Non-metal-based detergents include, for example, succinimide. Anti-foaming agents include, for example, methylsilicone, dimethylsilicone, fluorosilicones and polyacrylates.

An explanation will now be given of the blending quantities in the grease composition according to the present aspect.

The blending quantity of the base oil is preferably 60 to 99 parts by mass, more preferably 70 to 97 parts by mass, and further preferably 80 to 95 parts by mass, relative to 100 parts by mass of the overall grease composition.

The blending quantity of the calcium complex soap contained in the thickening agent is preferably 1 to 40 parts by mass, more preferably 3 to 25 parts by mass, and further preferably 5 to 20 parts by mass, relative to 100 parts by mass of the overall grease composition.

The blending quantity of the higher fatty acid contained in the calcium complex soap is preferably approximately 0.5 to 22 parts by mass, more preferably 1 to 18 parts by mass, and further preferably 2 to 15 parts by mass, relative to 100 parts by mass of the overall grease composition.

The blending quantity of the aromatic fatty acid contained in the calcium complex soap is preferably 0.05 to 5 parts by mass, more preferably 0.1 to 4 parts by mass, and further preferably 0.5 to 3 parts by mass, relative to 100 parts by mass of the overall grease composition.

The blending quantity of the lower fatty acid contained in the calcium complex soap is preferably 0.15 to 7 parts by mass, more preferably 0.5 to 6 parts by mass, and further preferably 1 to 5 parts by mass, relative to 100 parts by mass of the overall grease composition.

The mass ratio of the base oil to the calcium complex soap is preferably between 99:1 and 60:40, more preferably between 97:3 and 70:30, and further preferably between 95:5 and 80:20.

The quantity of the higher fatty acid relative to 100 parts by mass of the total fatty acid content is preferably 62 to 70 parts by mass, more preferably 64 to 69 parts by mass, and further preferably 65 to 68 parts by mass.

The quantity of the aromatic fatty acid relative to 100 parts by mass of the total fatty acid content is preferably 2 to 17 parts by mass, more preferably 4 to 16 parts by mass, and further preferably 5 to 15 parts by mass.

The quantity of the lower fatty acid relative to 100 parts by mass of the total fatty acid content is preferably 10 to 24 parts by mass, more preferably 11 to 20 parts by mass, and further preferably 12 to 17 parts by mass.

The mass ratio of the aromatic fatty acid relative to the higher fatty acid is preferably between approximately 97:3 and 70:30, more preferably between approximately 95:5 and 75:25, and further preferably between approximately 92:8 and 78:22. If the proportion of the aromatic fatty acid exceeds 30%, a grease structure does not form, and if the proportion of the aromatic fatty acid is less than 3%, it is thought that heat resistance will not be achieved.

The mass ratio of the lower fatty acid relative to the higher fatty acid is preferably between approximately 85:15 and 65:35, more preferably between approximately 82:18 and 70:30, and further preferably between approximately 80:20 and 72:28. If the proportion of the lower fatty acid exceeds 35%, a grease structure does not form, and if the proportion of the aromatic fatty acid is less than 15%, it is thought that heat resistance will not be achieved.

The mass ratio of the lower fatty acid relative to the aromatic fatty acid is preferably between approximately 53:47 and 10:90, more preferably between approximately 51:49 and 15:85, and further preferably between approximately 50:50 and 20:80. If the proportion of the lower fatty acid exceeds 90 mass %, it is thought that the viscosity will decrease and a grease structure will not form.

The grease composition of the present aspect can be produced using a commonly used grease production method. Although not particularly limited, it is possible to, for example, place the base oil, higher fatty acid, lower fatty acid and aromatic fatty acid in a grease production tank and melt the contents at a temperature of 60 to 120° C. Next, an appropriate quantity of calcium hydroxide dissolved or dispersed in advance in distilled water is introduced into the aforementioned tank. The fatty acids and the basic calcium (typically calcium hydroxide) undergo a saponification reaction, thereby gradually generating a soap in the base oil, and this is then heated so as to complete dehydration and form a grease thickening agent. Following completion of the dehydration, the temperature is increased to 180 to 220° C., blending is effected through vigorous stirring, and the mixture is then allowed to return to room temperature. A homogeneous grease composition is then obtained by using a disperser (for example a three-roll mill).

The dropping point of the grease composition of the present aspect is preferably 180° C. or higher, more preferably 210° C. or higher, further preferably 250° C. or higher, and particularly preferably 260° C. or higher. If the dropping point of the grease composition is 180° C. or higher (which is at least 50° C. higher than that of an ordinary calcium grease), it is thought that lubrication problems such as the possibility of loss of viscosity at high temperatures, which can result in leakage or burning, can be suppressed. Moreover, dropping point means the temperature at which the thickening agent structure is lost when the temperature of a viscous grease is increased. Here, the dropping point is measured in accordance with JIS K 2220 8.

In a thickness test, the grease of the present aspect preferably has a thickness of No. 000 to No. 6 (85 to 475), more preferably a thickness of No. 0 to No. 4 (175 to 385), and further preferably a thickness of No. 1 to No. 3 (220 to 340). Moreover, the thickness represents the apparent hardness of the grease. Here, the method for measuring the thickness can be one in which worked penetration is measured, in accordance with JIS K 2220 7.

In a thin film heating test (150° C. for 24 hours), the grease composition of the present aspect exhibits an evaporation loss of less than 10%, preferably less than 7%, and more preferably less than 4%. Here, the method used in the thin film heating test is as follows. A sample weighing 3.0 g±0.1 g was coated on the central area portion (50 mm×70 mm) of one surface of a test piece made from an SPCC steel sheet, as specified in the humidity test method of JIS K 2246, having a thickness of 1.0 to 2.0 mm, a height of 60 mm and a width of 80 mm, and subjected to a heating test at 150° C. for 24 hours, the weight of the SPCC steel sheet was measured before and after the heating test, and the evaporated quantity was determined from the formula below. Moreover, in the thin film heating test, 0.5 parts by mass of p,p'-dioctyldiphenylamine was added to 99.5 parts by mass of each of the grease compositions disclosed in Working Examples 1 to 11 and Comparative Examples 1 to 4, with the total blending quantity of the grease composition being 100 parts by mass.

Evaporated quantity (%)=(weight (g) prior to heating test−weight (g) following heating test)/(weight (g) prior to heating test)×100

If changes in the state (changes in colour, hardness and the like) of the grease following the thin film heating test are slight, the composition is good. The hardness of the grease prior to the test should be maintained, the grease should not become fluid, and the appearance of the grease should be similar to that of the grease prior to the test or a pale brown colour.

The grease composition of the present aspect can of course be used in commonly used machinery, bearings, gears and the like, and can also exhibit excellent performance under harsher conditions, such as under high-temperature conditions. In vehicles, for example, the grease composition of the present aspect can be preferably used to lubricate engine peripherals such as starters, alternators and various actuators, propeller shafts, constant velocity joints (CVJ), wheel bearings, powertrain components such as clutches, electrical power steering (EPS), braking devices, ball joints, door hinges, handles, cooling fan motors, brake expanders and the like. Furthermore, the grease composition of the present aspect can also be used in construction equipment such as power shovels, bulldozers and cranes, and a variety of locations that are subjected to high temperatures and high loads, such as the iron and steel industry, the papermaking industry, forestry equipment, agricultural equipment, chemical plants, power stations, drying furnaces, copiers, railway vehicles and threaded joints for seamless pipes. Intended uses include hard disc bearings, plastic lubrication and cartridge greases, and the grease composition of the present aspect can also be preferably used in these intended uses.

EXAMPLES

The present invention will now be explained in greater detail through the use of working examples and comparative examples, but is in no way limited to these examples.

The raw materials used in the working examples and comparative examples are as follows. Moreover, if not explicitly disclosed, the quantities shown in Working Examples 1 to 11 and Comparative Examples 1 to 5 are as shown in Table 1 below. Moreover, the raw material quantities disclosed in Table 1 (especially those of calcium hydroxide and fatty acids) are the quantities of the reagents. Therefore, the actual quantities of the components in the composition are calculated on the basis of the numerical values shown in Table 1 and the purities given below.

Thickening Agent Raw Materials

Calcium hydroxide: Special grade, purity 96.0%

Stearic acid: Special grade straight chain saturated fatty acid having 18 carbon atoms in the alkyl chain, purity 95.0%

Oleic acid: First class grade straight chain unsaturated fatty acid having 18 carbon atoms in the alkyl chain, purity approximately 60.0%

Behenic acid: Straight chain saturated fatty acid having 22 carbon atoms in the alkyl chain, purity 99.0%

Benzoic acid: Special grade, purity 99.5%

Para-toluic acid: Special grade benzoic acid having a methyl group at the p-position, purity 98.0%

Acetic acid: Special grade alkyl fatty acid having 2 carbon atoms, purity 99.7%

Propionic acid: Special grade alkyl fatty acid having 3 carbon atoms, purity 98.0%

Butyric acid: Special grade alkyl fatty acid having 4 carbon atoms, purity 98.0%

Formic acid: Special grade alkyl fatty acid having 1 carbon atom, purity 98.0%

Base Oils A to D

Base oil A: Paraffin-based mineral oil obtained by dewaxing and solvent refining, group 1 base oil, kinematic viscosity 11.25 $mm^2/s$ at 100° C., viscosity index 97.

Base oil B: Poly-α-olefin, group 4 base oil, kinematic viscosity 6.34 $mm^2/s$ at 100° C., viscosity index 136.

Base oil C: Paraffin-based mineral oil produced by high level hydrogenation refining, group 3 base oil, kinematic viscosity 7.603 $mm^2/s$ at 100° C., viscosity index 128.

Base oil D: GTL (gas-to-liquid) synthesized by the Fischer Tropsch method, group 3 base oil, kinematic viscosity 7.77 $mm^2/s$ at 100° C., kinematic viscosity 43.88 $mm^2/s$ at 400° C., viscosity index 148.

Working Example 1

Base oil A as a raw material and stearic acid, acetic acid and benzoic acid were placed in a grease production tank and heated to 90° C. so as to melt the contents of the tank. Next, an appropriate quantity of calcium hydroxide dissolved or dispersed in advance in distilled water was introduced into the tank. Here, the fatty acids and the basic calcium underwent a saponification reaction, thereby gradually generating a soap in the base oil, and this was then heated so as to complete dehydration and form a grease thickening agent. Following completion of the dehydration, the temperature was increased to 200° C., blending was effected through vigorous stirring, and the mixture was then allowed to return to room temperature. A homogeneous grease having a No. 3 thickness was then obtained using a three-roll mill.

Working Example 2

Base oil A as a raw material and oleic acid, acetic acid and benzoic acid were placed in a grease production tank, and a homogeneous grease having a No. 2 thickness was obtained in the same way as in Working Example 1.

Working Example 3

Base oil A as a raw material and stearic acid, acetic acid and para-toluic acid were placed in a grease production tank, and a homogeneous grease having a No. 1.5 thickness was obtained in the same way as in Working Example 1.

Working Example 4

Base oil A as a raw material and stearic acid, butyric acid and benzoic acid were placed in a grease production tank, and a homogeneous grease having a No. 2 thickness was obtained in the same way as in Working Example 1.

Working Example 5

Base oil A as a raw material and behenic acid, acetic acid and benzoic acid were placed in a grease production tank, and a homogeneous grease having a No. 3 thickness was obtained in the same way as in Working Example 1.

Working Example 6

Using the blending quantities shown for Working Example 5 in Table 1, a homogeneous grease having a No. 0 thickness was obtained in the same way as in Working Example 1.

Working Example 7

Using the blending quantities shown for Working Example 5 in Table 1, a homogeneous grease having a No. 00 thickness was obtained in the same way as in Working Example 1.

Working Example 8

Base oil B as a raw material and behenic acid, acetic acid and benzoic acid were placed in a grease production tank at the blending quantities shown for Working Example 6 in Table 1, and a homogeneous grease having a No. 2 thickness was obtained in the same way as in Working Example 1.

Working Example 9

Base oil C as a raw material and stearic acid, acetic acid and benzoic acid were placed in a grease production tank at the blending quantities shown for Working Example 7 in Table 1, and a homogeneous grease having a No. 2 thickness was obtained in the same way as in Working Example 1.

Working Example 10

Base oil D as a raw material and stearic acid, acetic acid and benzoic acid were placed in a grease production tank, and a homogeneous grease having a No. 2 thickness was obtained in the same way as in Working Example 1.

Working Example 11

A base oil obtained by blending base oils A, B, C and D as a raw material and stearic acid, acetic acid and benzoic acid were placed in a grease production tank, and a homogeneous grease having a No. 2.5 thickness was obtained in the same way as in Working Example 1.

Comparative Example 1

Base oil A as a raw material and stearic acid were placed in a grease production tank and heated to 90° C. so as to melt the contents of the tank. Next, an appropriate quantity of calcium hydroxide dissolved or dispersed in advance in distilled water was introduced into the tank. Here, the fatty acid and the basic calcium underwent a saponification reaction, thereby gradually generating a soap in the base oil, and this was then heated so as to complete dehydration and form a grease thickening agent. Following completion of the dehydration, the temperature was increased to 130° C., blending was effected through vigorous stirring, and the mixture was then allowed to return to room temperature. A homogeneous grease was then obtained using a three-roll mill.

Comparative Example 2

Base oil A as a raw material and stearic acid and acetic acid were placed in a grease production tank and heated to 90° C. so as to melt the contents of the tank. Next, an appropriate quantity of calcium hydroxide dissolved or dispersed in advance in distilled water was introduced into the tank. Here, the fatty acids and the basic calcium underwent a saponification reaction, thereby gradually generating a soap in the base oil, and this was then heated so as to complete dehydration and form a grease thickening agent. Following completion of the dehydration, the temperature was increased to 200° C., blending was effected through vigorous stirring, and the mixture was then allowed to return to room temperature. A homogeneous grease was then obtained using a three-roll mill.

Comparative Example 3

Base oil A as a raw material and stearic acid and benzoic acid were placed in a grease production tank, and a grease was obtained using similar blending quantities to those shown in the table in accordance with the production method used in Comparative Example 2.

Comparative Example 4

Base oil A as a raw material and stearic acid, benzoic acid and formic acid were placed in a grease production tank, and a grease was obtained using similar blending quantities to those shown in the table in accordance with the production method used in Comparative Example 2, but the grease separated and produced a fluid substance.

Comparative Example 5

A commercially available lithium-based grease produced by Showa Shell was used, lithium 12-hydroxystearate soap was used as a thickening agent and a mineral oil-based lubricating oil was used in a base oil, and the viscosity of the base oil was 12.2 $mm^2/s$ at 100° C.

The abovementioned results are shown in Table 1 and Table 2. Moreover, the "Not measurable" for Comparative Example 1 in Table 2 means that it was not possible to obtain a precise measured value for the evaporation loss due to the grease composition becoming fluid and flowing away. In addition, the "Not measurable" for Comparative Example 4 means that the dropping point could not be measured because it was not possible to obtain a grease structure due to the base oil and the thickening agent separating.

TABLE 1

| Working Example | | 1 | 2 | 3 | 4 | 5 | 6 | 7 | 8 | 9 | 10 | 11 |
|---|---|---|---|---|---|---|---|---|---|---|---|---|
| (a) Thickening agent | (mass %) | 3.99 | 3.99 | 4.33 | 3.57 | 4.32 | 2.16 | 1.30 | 4.32 | 3.99 | 3.99 | 3.99 |
| Alkali | Calcium hydroxide | | | | | | | | | | | |
| Higher fatty acid | Stearic acid | 10.98 | | 10.87 | 10.22 | | | | | 10.88 | 10.88 | 10.88 |
| | Oleic acid | | 10.88 | | | | | | | | | |
| | Behenic acid | | | | | 9.66 | 4.83 | 2.89 | 9.66 | | | |
| Aromatic fatty acid | Benzoic acid | 1.00 | 1.00 | | 2.69 | 1.95 | 0.98 | 0.59 | 1.95 | 1.00 | 1.00 | 1.00 |
| | Paratoluic acid | | | 1.00 | | | | | | | | |
| Lower fatty acid | Acetic acid | 3.48 | 3.48 | 3.42 | | 3.42 | 1.71 | 1.03 | 3.42 | 3.48 | 3.48 | 3.48 |
| | Butyric acid | | | | 2.70 | | | | | | | |
| | Formic acid | | | | | | | | | | | |
| Total thickening agent | | 19.35 | 19.35 | 19.62 | 19.18 | 19.35 | 9.68 | 5.81 | 19.35 | 19.35 | 19.35 | 19.35 |
| (b) Base oil | (mass %) | 80.65 | 80.65 | 80.38 | 80.82 | 80.65 | 90.32 | 94.19 | | | | 20.65 |
| Base oil A | | | | | | | | | | | | |
| Base oil B | | | | | | | | | 80.65 | | | 20.00 |
| Base oil C | | | | | | | | | | 80.65 | | 20.00 |
| Base oil D | | | | | | | | | | | 80.65 | 20.00 |
| Composition total (%) | | 100.00 | 100.00 | 100.00 | 100.00 | 100.00 | 100.00 | 100.00 | 100.00 | 100.00 | 100.00 | 100.00 |
| Properties Colour | | Pale yellow | Pale yellow | Pale yellow | Pale yellow | Pale yellow | Pale yellow | Pale yellow | Pale white | Pale white | Pale white | Pale yellow |
| State | | Grease | Grease | Grease | Grease | Grease | Grease | Grease | Grease | Grease | Grease | Grease |
| Quality of texture | | ◎ | ◎ | ◎ | ○ | ○ | ○ | ○ | ○ | ◎ | ◎ | ◎ |
| Viscoelasticity (body strength) | | ◎ | ○ | ○ | Δ | ◎ | ◎ | Δ | ◎ | ◎ | ◎ | ◎ |
| Ease of production (ease of dehydration and so on) | | ◎ | ○ | ○ | Δ | ○ | ○ | ○ | ○ | ◎ | ◎ | ◎ |
| Thickness | Worked penetration | 247 | 288 | 307 | 271 | 212 | 374 | 408 | 273 | 267 | 271 | 257 |
| NLG thickness grade | | No. 3 | No. 2 | No. 1.5 | No. 2 | No. 3 | No. 0 | No. 00 | No. 2 | No. 2 | No. 2 | No. 2.5 |
| Dropping point ° C. | | >260 | >260 | >260 | 211 | >260 | >260 | 241 | >260 | >260 | >260 | >260 |
| Thin film heating test | Evaporation loss (%) | 3.95 | 3.33 | 3.37 | 3.34 | 3.90 | 5.12 | 6.54 | 3.94 | 3.74 | 3.85 | 3.27 |
| 150° C., 24 hours | Observed grease colour | Pale yellow | Pale yellow | Pale brown | Pale brown | Pale yellow | Pale yellow | Pale yellow | Pale yellow | Pale yellow | Pale yellow | Pale yellow |

TABLE 2

| Comparative Example | | 1 | 2 | 3 | 4 | 5 |
|---|---|---|---|---|---|---|
| (a) Thickening agent | (mass %) | 1.16 | 3.99 | 2.25 | 4.35 | Commercially available lithium grease |
| Alkali | Calcium hydroxide | | | | | |
| Higher fatty acid | Stearic acid | 9.40 | 10.88 | 6.40 | 10.87 | |
| | Oleic acid | | | | | |
| | Behenic acid | | | | | |
| Aromatic fatty acid | Benzoic acid | | | 2.74 | 1.00 | |
| | Paratoluic acid | | | | | |
| Lower fatty acid | Acetic acid | | 3.48 | | | |
| | Butyric acid | | | | | |
| | Formic acid | | | | 3.19 | |
| Total thickening agent | | 10.56 | 18.35 | 11.39 | 19.41 | |
| (b) Base oil | (mass %) | 89.44 | 81.65 | 88.61 | 80.59 | |
| Base oil A | | | | | | |
| Base oil B | | | | | | |
| Base oil C | | | | | | |
| Base oil D | | | | | | |
| Composition total (%) | | 100.00 | 100.00 | 100.00 | 100.00 | |
| Properties Colour | | Pale yellow | Pale yellow | Pale yellow | Pale yellow | Pale brown |
| State | | Grease | Grease | Grease | Separated Fluid | Grease |
| Quality of texture | | ○ | ○ | ○ | X | ◎ |
| Viscoelasticity (body strength) | | Δ | Δ | Δ | X | ○ |
| Ease of production (ease of dehydration and so on) | | Δ | Δ | Δ | X | ◎ |
| Thickness | Worked penetration | 328 | 314 | 349 | — | 273 |
| NLG thickness grade | | No. 1 | No. 1 | No. 0.5 | — | No. 2 |
| Dropping point (° C.) | | 108 | 170 | 114 | Not measurable | 185 |
| Thin film heating test | Evaporation loss (%) | Not measurable | 6.77 | 6.07 | — | 15.00 |
| 150° C., 24 hours | Observed grease colour | Brown | Pale brown | Brown | — | Dark brown |

As is clear from Table 1 and Table 2, Comparative Examples 1 and 2 (grease compositions that did not contain an aromatic fatty acid) and Comparative Example 3 (a grease composition that did not contain a lower fatty acid) all had a low dropping point and did not exhibit heat resistance, Comparative Example 4 could not form a grease structure due to the base oil and the thickening agent separating, and Comparative Example 5 (a commercially available lithium grease) underwent significant evaporation loss and discolouration. However, the working examples according to the present invention all had dropping points in excess of 200° C., had suitable thicknesses for greases, underwent little evaporation loss at high temperatures, exhibited excellent thermal stability and exhibited stable lubrication activity even in high-temperature regions.

That which is claimed is:

1. A grease composition comprising:

a base oil and a thickening agent comprising a calcium complex soap, wherein the calcium complex soap comprises:

(1) a calcium soap of a higher fatty acid present in an amount of 2 to 15 parts by mass, wherein the higher fatty acid is a substituted or unsubstituted straight chain higher mono-fatty acid having 18 to 22 carbon atoms, (2) a calcium soap of an aromatic fatty acid present in an amount of 0.5 to 3 parts by mass, wherein the aromatic fatty acid is an aromatic mono-fatty acid having a substituted or unsubstituted benzene ring and (3) a calcium soap of a lower fatty acid present in an amount of 1 to 5 parts by mass, relative to 100 parts by mass of the overall grease composition, wherein the lower fatty acid is a straight chain saturated lower mono-fatty acid having 2 to 4 carbon atoms wherein the amount of the higher fatty acid, relative to 100 parts by mass of the total fatty acid content, is greater than the amount of the lower fatty acid.

2. The grease composition according to claim 1, wherein the dropping point is at least 180° C. or higher, as measured by JIS K 2220 8.

3. The grease composition according to claim 1, wherein:

the higher fatty acid is selected from the group consisting of: stearic acid, oleic acid, 12-hydroxystearic acid, behenic acid, and a combination thereof, the aromatic fatty acid is selected from the group consisting of: benzoic acid, para-toluic acid, and a combination thereof, and the lower fatty acid is acetic acid.

4. The grease composition of claim 1, wherein the dropping point is at least 250° C. or higher, as measured by JIS K 2220 8.

5. The grease composition according to claim 1, wherein the higher fatty acid is selected from the group consisting of: stearic acid, oleic acid, 12-hydroxystearic acid, behenic acid, and a combination thereof.

6. The grease composition according to claim 1, wherein the aromatic fatty acid is selected from the group consisting of: benzoic acid, para-toluic acid, and a combination thereof.

7. The grease composition according to claim 1, wherein the lower fatty acid is acetic acid.

8. The grease composition according to claim 1, wherein the base oil is present in an amount of 60 to 99 parts by mass, relative to 100 parts by mass of the overall grease composition.

9. The grease composition according to claim 1, wherein the calcium complex soap is present in an amount of 1 to 40 parts by mass, relative to 100 parts by mass of the overall grease composition.

10. A method for preparing a grease composition comprising:

combining a base oil, calcium hydroxide, a higher fatty acid, an aromatic fatty acid, and a lower fatty acid to form the grease composition wherein:

(1) the higher fatty acid is a substituted or unsubstituted straight chain higher mono-fatty acid having 18 to 22 carbon atoms present in an amount of 2 to 15 parts by mass, (2) the aromatic fatty acid is an aromatic mono-fatty acid having a substituted or unsubstituted benzene ring present in an amount of 0.5 to 3 parts by mass, and (3) the lower fatty is a straight chain saturated lower mono-fatty acid having 2 to 4 carbon atoms present in an amount of 1 to 5 parts by mass, relative to 100 parts by mass of the overall grease composition, wherein the amount of the higher fatty acid, relative to 100 parts by mass of the total fatty acid content, is greater than the amount of the lower fatty acid.

11. The method according to claim 10, wherein the dropping point is at least 180° C. or higher, as measured by JIS K 2220 8.

12. The method according to claim 10, wherein the dropping point is at least 250° C. or higher, as measured by JIS K 2220 8.

13. The method according to claim 10, wherein:

the higher fatty acid is selected from the group consisting of: stearic acid, oleic acid, 12-hydroxystearic acid, behenic acid, and a combination thereof, the aromatic fatty acid is selected from the group consisting of: benzoic acid, para-toluic acid, and a combination thereof, and the lower fatty acid is acetic acid.

14. The method according to claim 10, wherein the base oil is present in an amount of 60 to 99 parts by mass, relative to 100 parts by mass of the overall grease composition.

15. The method according to claim 10, wherein the calcium complex soap is present in an amount of 1 to 40 parts by mass, relative to 100 parts by mass of the overall grease composition.

16. The grease composition according to claim 1, wherein the higher fatty acid is present in an amount of 62 to 70 parts by mass, relative to 100 parts by mass of the total fatty acid content.

17. The grease composition according to claim 1, wherein the aromatic fatty acid is present in an amount of 2 to 17 parts by mass, relative to 100 parts by mass of the total fatty acid content.

18. The grease composition according to claim 1, wherein the lower fatty acid is present in an amount of 10 to 24 parts by mass, relative to 100 parts by mass of the total fatty acid content.

19. The method according to claim 10, wherein the higher fatty acid is present in an amount of 62 to 70 parts by mass, relative to 100 parts by mass of the total fatty acid content.

20. The method according to claim 10, wherein the aromatic fatty acid is present in an amount of 2 to 17 parts by mass, relative to 100 parts by mass of the total fatty acid content.

21. The method according to claim 10, wherein the lower fatty acid is present in an amount of 10 to 24 parts by mass, relative to 100 parts by mass of the total fatty acid content.

* * * * *